US007988153B2

(12) United States Patent
Chang

(10) Patent No.: US 7,988,153 B2
(45) Date of Patent: Aug. 2, 2011

(54) WESTERNIZED MAHJONG GAME COMPOSED OF SPECIALIZED PLAYING CARDS OR TILES

(76) Inventor: Philip Y. F. Chang, Renton, WA (US)

( * ) Notice: Subject to any disclaimer, the term of this patent is extended or adjusted under 35 U.S.C. 154(b) by 0 days.

(21) Appl. No.: 12/769,963

(22) Filed: Apr. 29, 2010

(65) Prior Publication Data

US 2010/0289219 A1 Nov. 18, 2010

(51) Int. Cl.
*A63F 1/00* (2006.01)

(52) U.S. Cl. ..... 273/304; 273/303; 273/292; 273/308; D21/378; D21/379; D21/376

(58) Field of Classification Search ..... 273/302–308, 273/292; D21/378, 379, 376
See application file for complete search history.

(56) References Cited

U.S. PATENT DOCUMENTS

| | | | | |
|---|---|---|---|---|
| 4,147,363 | A * | 4/1979 | Lee et al. | 273/304 |
| 4,480,840 | A * | 11/1984 | Chang | 273/292 |
| 7,389,989 | B1 | 6/2008 | Hong | |
| 2008/0113704 | A1 | 5/2008 | Jackson | |
| 2008/0132316 | A1 | 6/2008 | Fisher et al. | |
| 2008/0293475 | A1 | 11/2008 | Toyoda | |

* cited by examiner

*Primary Examiner* — Benjamin Layno
(74) *Attorney, Agent, or Firm* — Thomas E. Loop; Graybeal Jackson LLP

(57) ABSTRACT

The invention disclosed herein relates to a game that uses a plurality of specialized playing cards or tiles that entwines traditional symbols of Chinese origin (associated with the tile game of mahjong) together with numerically ranked and suited playing cards (associated with western-style card decks of the 52 playing card to a deck variety). Each inventive card or tile has displayed on one of its faces a symbol of Chinese origin, a numerical rank, and a suit of French origin. The symbol of Chinese origin is selected from the group consisting of a wan, a bamboo, a ring, a dragon, or a wind; whereas the numerical rank is selected the group consisting of a 1, 2, 3, 4, 5, 6, 7, 8, 9, 10, jack, queen, and king; and whereas the suit is selected from the group consisting of a spade, a heart, a club, and a diamond.

14 Claims, 19 Drawing Sheets

WESTERNIZED MAHJONG GAME COMPOSED OF SPECIALIZED PLAYING CARDS OR TILES

TECHNICAL FIELD

The present invention relates generally to games and, more particularly, to games involving the use of playing cards or tiles.

BACKGROUND OF THE INVENTION

Mahjong is a game of Chinese origin commonly played by four persons with tiles resembling dominoes and bearing various symbols and designs. The playing tiles are drawn and discarded from a common pile until one player wins. A full set of mahjong playing tiles commonly contains 144 tiles with each tile having a unique symbol (namely, a wan, a bamboo, a ring, a dragon, or a wind) engraved or painted on its face. Mahjong involves skill, strategy, and calculation, as well as a certain degree of luck (depending on the variation played, luck can be anything from a minor to a dominant factor in winning). Mahjong is also popularly played as a gambling game.

More specifically, and depending on the particular variation of the game, each player is dealt either thirteen or sixteen tiles in a hand. On their turn, players draw utile and discard one tile, with the goal of making four or five sets of threes known as "melds" (depending on the variation) and one pair, or "head." Winning comes "on the draw" by drawing anew or discarded tile that completes the hand. Thus, a winning hand generally contains fourteen (or seventeen) tiles.

Stated somewhat differently, the objective of the game of mahjong is to put together a complete set (or "hand"), which contains three or four sets of threes or "melds" (either three of a kind of the same suit (or "pung") or a sequence of the same suit (or "chow")) and a pair, for total of 14 (or 17) pieces (tiles). Each player starts with 13 (or 16) tiles. With each turn, a player picks up a 14th (or $17^{th}$) tile, and then discards one tile placed face up in the center of the table. At this point, other players can choose to pass, take the tile to complete a set (pung, chow, or kong) or to declare a win ("mahjong"). The first player who completes the set of 14 (or 17) tiles wins the hand.

In contrast to traditional mahjong-style playing tiles of Chinese origin, European or western-style playing cards generally consist of pieces of specially prepared heavy paper, thin card, or thin plastic, figured with distinguishing motifs that are suited and numerically ranked. Playing cards are typically palm-sized for convenient handling. A complete set of cards is called a pack or deck, and the set of cards held at one time by a player during a game is commonly called their hand. A deck of cards may be used for playing a great variety of card games, some of which may also incorporate gambling.

The front (or "face") of each playing card carries markings that distinguish it from the other cards in the deck and determine its use under the rules of the game being played. The back of each card is generally identical for all cards in any particular deck, and usually of a single color or formalized design. For most card games, the cards are assembled into a deck, and their order is randomized by shuffling.

The exact origin of playing cards is subject to a great deal of speculation and misinformation. There are many divided opinions, theories, and contradictions in the historical research of playing cards. Playing cards are thought to have entered Europe via the Islamic world where suit symbols were added in the form of cups and swords in addition to non-figurative images for court cards. In Europe the Islamic non-figurative court cards were replaced with representations of humans at royal courts including kings and queens. Two basic types of playing cards evolved in Europe that are in common use today; namely, the Tarot deck of 22 playing cards that depicts vices and virtues; and the deck of 52 playing cards divided into four suits (spades, hearts, clubs, and diamonds), with each suit consisting of 10 numbered or ranked cards (A, 2, 3, 4, 5, 6, 7, 8, 9, and 10), and three face cards (jacks, queens, and kings). European or western-style card decks sometimes include one or two additional bonus or wild cards commonly known as jokers.

The invention in the fourteenth century of "woodcut" printing enabled mass production of playing cards, which, in turn, popularized the use of playing cards throughout Europe. Because the French suit system of spades (♠),hearts (♥), clubs (♣),and diamonds (♦) were easy to stencil using red and black ink, the French colored suit system of black spades, red hearts, black clubs, and red diamonds became dominant and is now the most popular suit system in use today (although other suit systems are known to exist).

Playing cards were first produced in the United States around 1800. Americans adopted and invented several refinements including indexes (sometimes referred to as "pips"—defined as identifying marks placed on the cards' corners or borders). These were adopted to eliminate the problem of identification when fanning out the cards. The backs of cards were originally plain but designs were eventually added to prevent card sharps from recognizing cards with identifying marks or dirt on their backs. Round corners were added to eliminate the problem of wear and tear resulting from square corners.

Although significant advancements with playing tiles and cards have been made over time, there is still a need in the art for new and improved playing cards and tiles, especially playing cards and tiles that provide and allow for the playing of more complicated and/or different types of games. The present invention fulfills these needs and provides for further related advantages.

SUMMARY OF THE INVENTION

In brief, the present invention in one embodiment is directed to a game that comprises a plurality of playing cards or tiles, wherein each card or tile has displayed on one of its faces a symbol of Chinese origin, a numerical rank, and a suit of French origin. The symbol of Chinese origin is selected from the group consisting of a wan, a bamboo, a ring, a dragon, or a wind; whereas the numerical rank is selected the group consisting of a 1, 2, 3, 4, 5, 6, 7, 8, 9, and 10; and whereas the suit is selected from the group consisting of a spade, a heart, a club, and a diamond. In other embodiments, the game further comprises a face card selected from the group consisting of a jack, a queen, or a king, as well as a set of other special function cards known as "assistance" cards. Thus, the innovative game of the present invention entwines traditional symbols of Chinese origin (associated with the game of mahjong) together with numerically ranked and suited playing cards (associated with western-style card decks of the 52 playing card to a deck variety).

These and other aspects of the present invention will become more readily apparent to those possessing ordinary skill in the art when reference is made to the following detailed description in conjunction with the accompanying drawings.

BRIEF DESCRIPTION OF THE DRAWINGS

The drawings are intended to be illustrative and symbolic representations of certain exemplary embodiments of the present invention and as such they are not necessarily drawn to scale. In addition, it is to be expressly understood that the various symbols and markings depicted in the drawings are exemplary in nature; and thus they may be varied and/or colored in a variety of different ways (not shown). Finally, like reference numerals have been used to designate like features throughout the several views of the drawings.

DETAILED DESCRIPTION OF THE INVENTION

Figure 1:
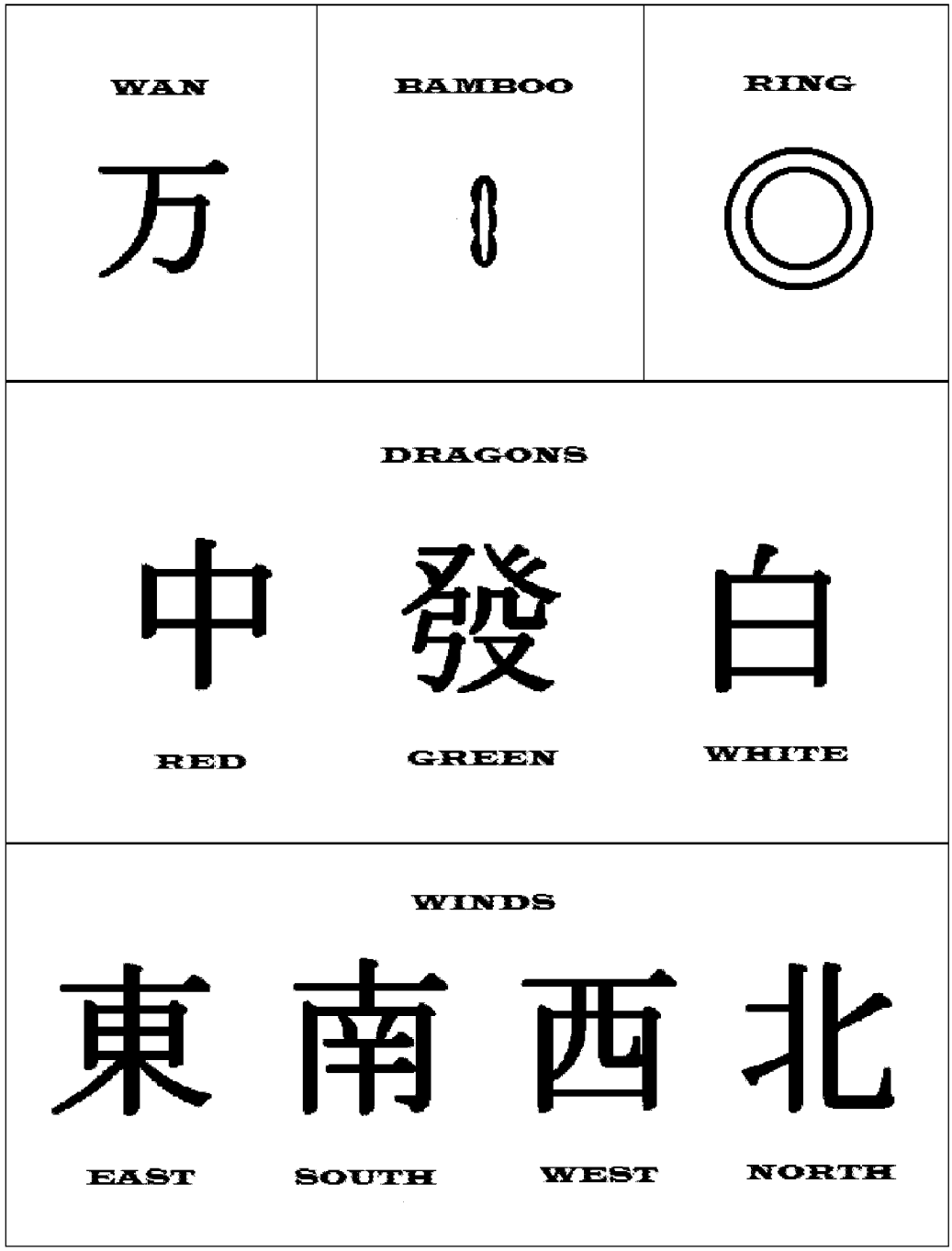
FIG. 1 is an illustration of five types of symbols of Chinese origin (including a "wan" symbol, a "bamboo" symbol, a "ring" symbol, three different "dragon" symbols, and four different "wind" symbols) associated with certain embodiments of the present invention.

In the following detailed description, reference is made to the accompanying drawings, which form a part hereof. In the drawings, similar symbols or markings typically identify like or corresponding elements, unless context dictates otherwise. The illustrative embodiments described in the detailed description, drawings, and claims are not meant to be limiting. Other embodiments may be utilized, and other changes may be made, without departing from the spirit or scope of the subject matter presented herein.

In view of the foregoing and referring now to the drawings and, more particularly, to FIGS. 1 through 8, the present invention in one embodiment is directed to a set of 196 playing cards or tiles, wherein each card or tile has displayed on one of its faces a symbol of Chinese origin (FIG. 1), a suit of French origin (FIG. 2), and a numerical rank ranging from 1-10, as well as jack (rank=11), queen (rank=12), and king (rank=13) (FIGS. 3A-5). Thus, the innovative game of the present invention entwines traditional symbols of Chinese origin together with numerically ranked and suited playing cards of European origin.

Figure 2:
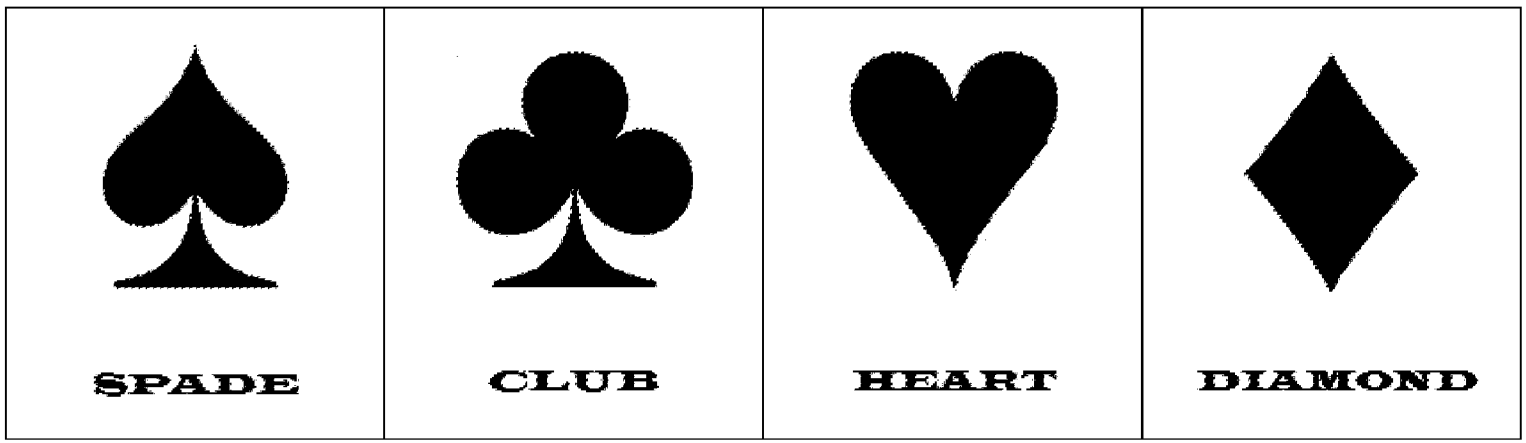
FIG. 2 is an illustration of four suits of French origin including a spade (♠), a heart (♥), a club (♣),and a diamond (♦) associated with certain embodiments of the present invention.
Figure 6:
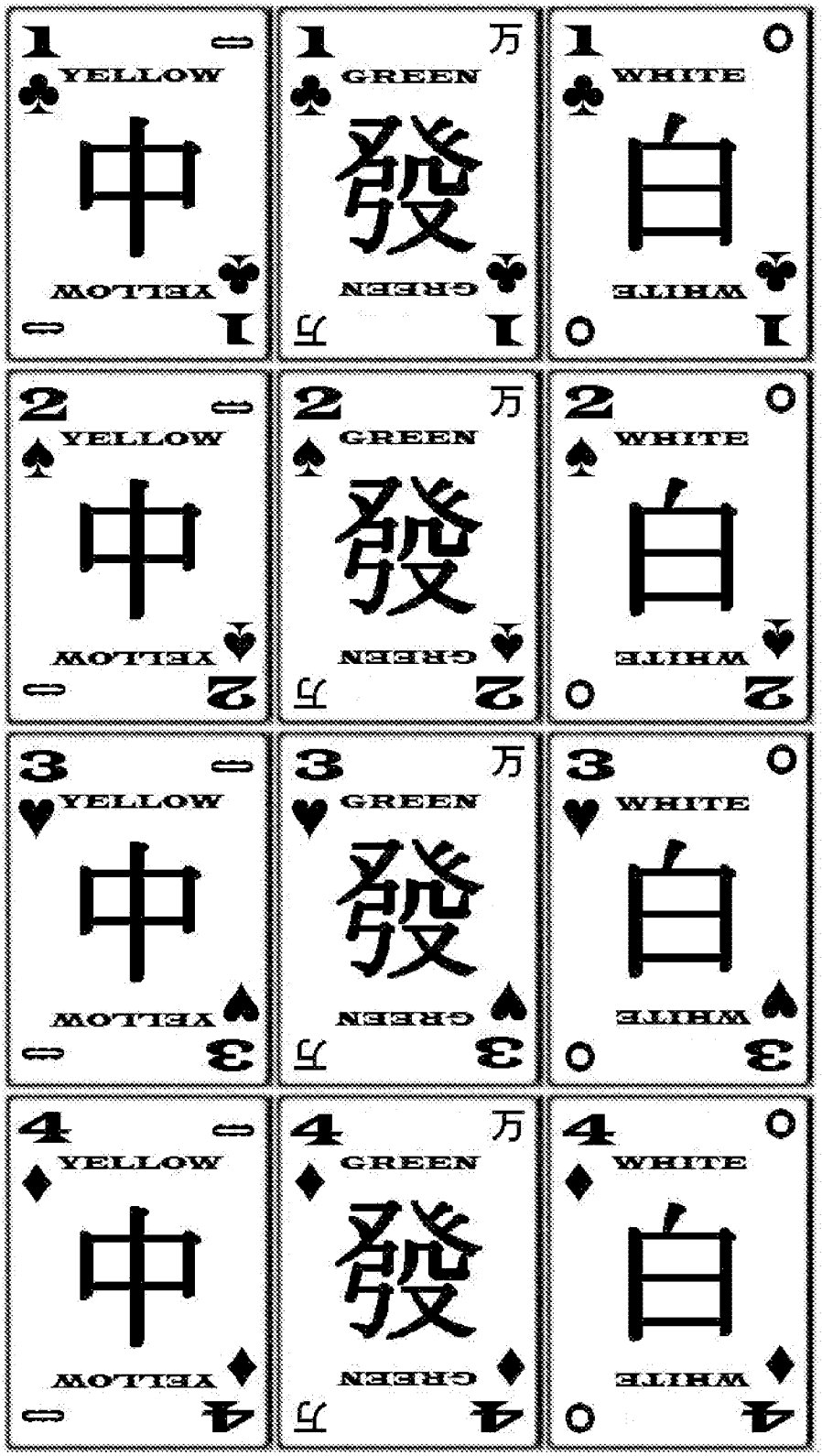
FIG. 6 is an illustration of a fourth group of 12 dragon playing cards or tiles arranged into four ordered rows with each row consisting of three different dragon playing cards or tiles of the same suit, all of which are associated with certain embodiments of the present invention.
Figure 7:
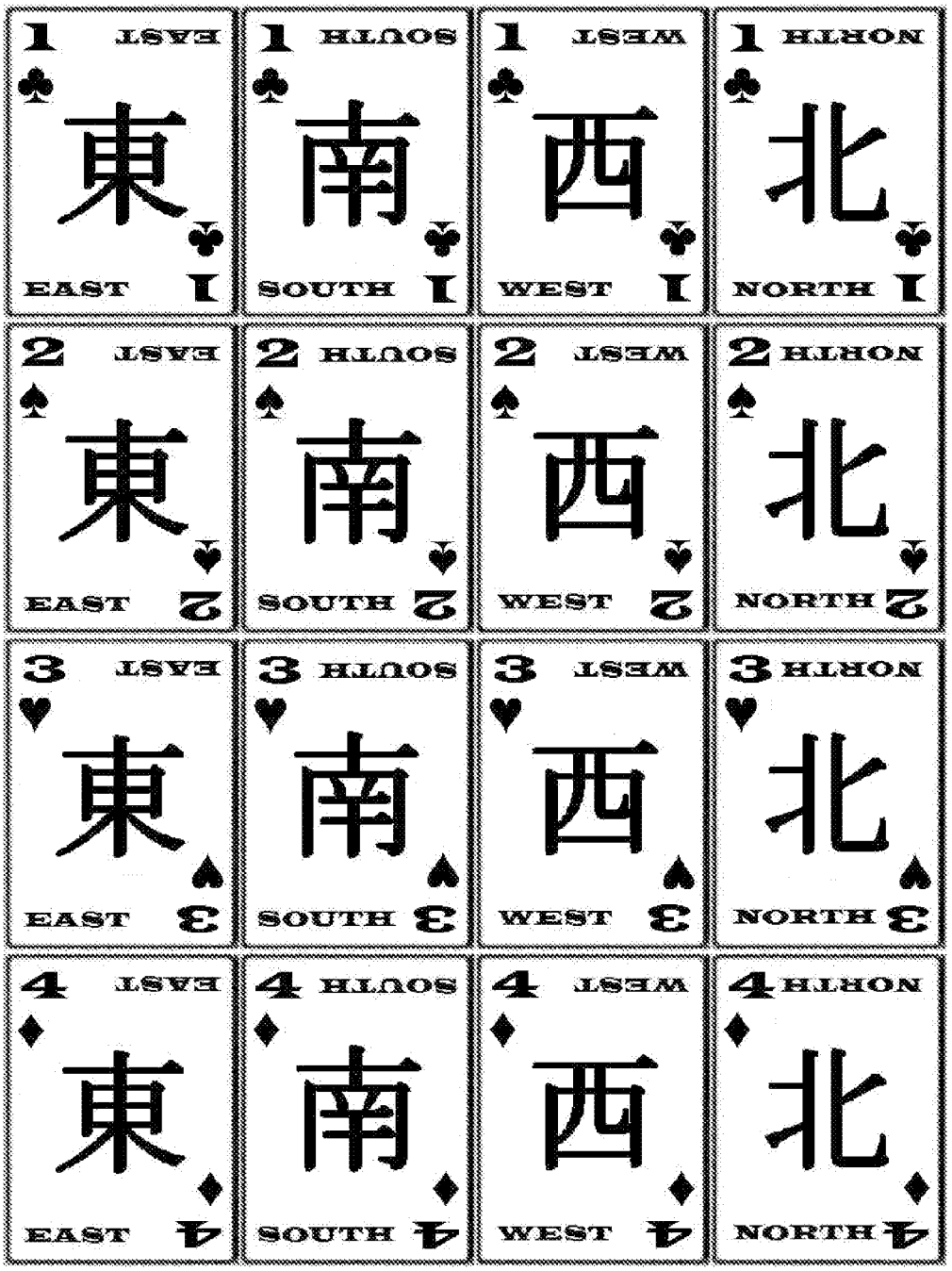
FIG. 7 is an illustration of a fifth group of 16 wind cards or tiles arranged into four ordered rows with each row consisting of four different wind playing cards or tiles of the same suit, all of which are associated with certain embodiments of the present invention.

In the context of certain preferred embodiments of the present invention, the symbol of Chinese origin is selected from the group consisting of a wan (FIGS. 1 and 3A-B), a bamboo (FIGS. 1 and 4A-B), a ring (FIGS. 1 and 5A-B), a dragon (FIGS. 1 and 6), or a wind (FIGS. 1 and 7); whereas the numerical rank symbol is selected the group consisting of a 1, 2, 3, 4, 5, 6, 7, 8, 9, 10, jack, queen, or king (FIGS. 3A, 4A, and 5A); and whereas the suit symbol is selected from the group consisting of a spade, a heart, a club, and a diamond (FIG. 2). In other embodiments, the game further comprises a set of face cards (FIGS. 3A, 4A, and 5A) selected from the group consisting of a jack, a queen, or a king, a set of dragon cards selected from the group consisting of a first dragon, a second dragon, and a third dragon (FIG. 6), as well as a set of other special function cards known as "assistance" cards (FIG. 7). In still other embodiments, an ace replaces the numerical rank of 1 (not shown).

Figure 3A:
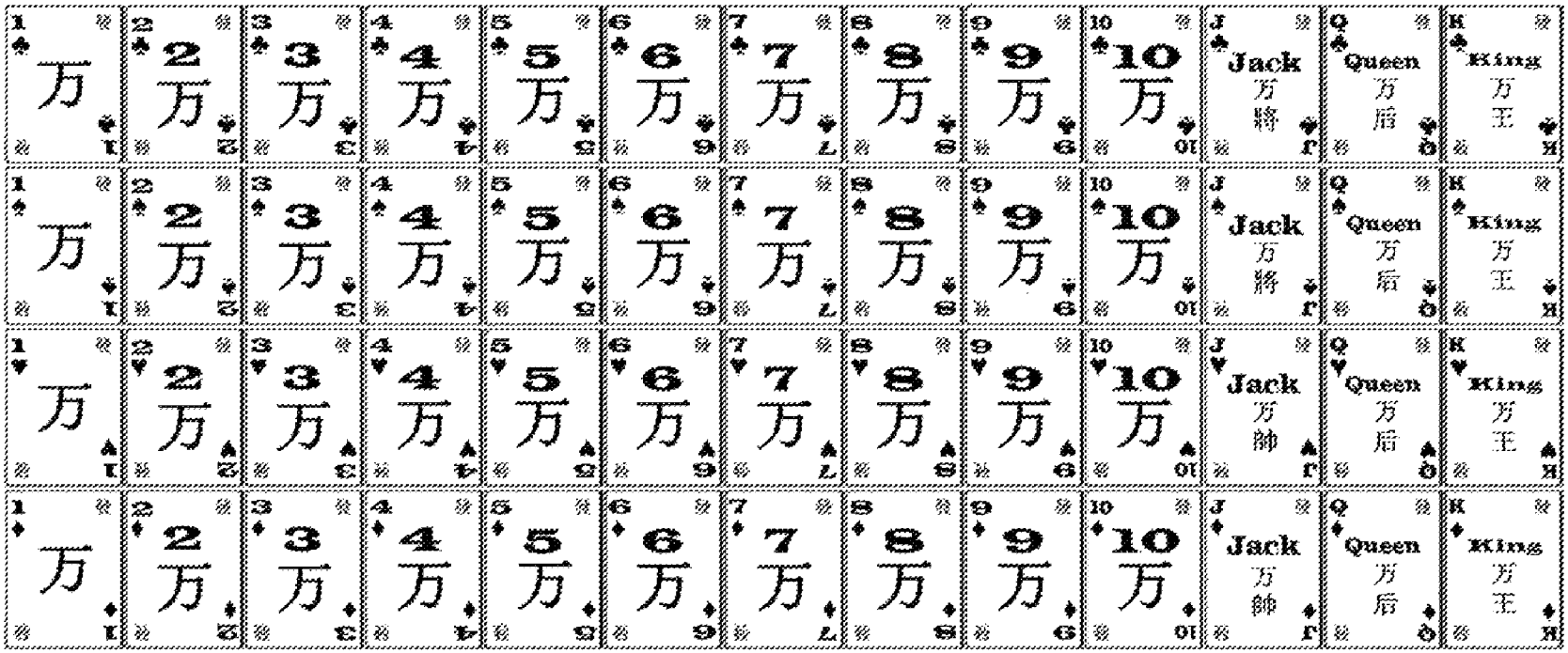
FIG. 3A is an illustration of a first group of 52 wan playing cards or tiles arranged in four rows, wherein the wan playing cards or tiles have displayed on one of their faces a "wan" symbol, a numerical rank ranging from 1 to 10, jack, queen, and king, and one of four suits selected from a spade, a heart, a club, or a diamond, all of which are associated with certain embodiments of the present invention.
Figure 4A:
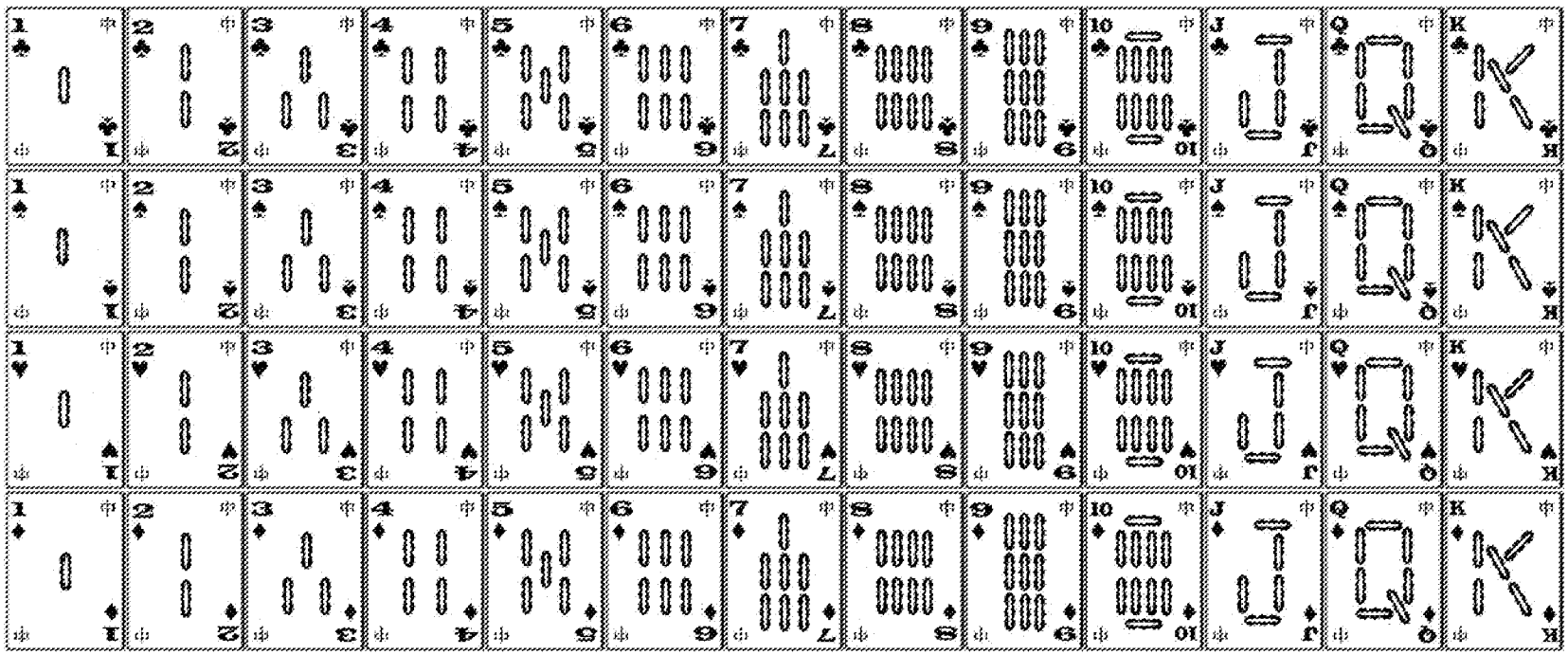
FIG. 4A is an illustration of a second group of 52 bamboo playing cards or tiles arranged in four rows, wherein the bamboo playing cards or tiles have displayed on one of their faces a "bamboo" symbol, a numerical rank ranging from 1 to 10, jack, queen, and king, and one of four suits selected from a spade, a heart, a club, or a diamond, all of which are associated with certain embodiments of the present invention.
Figure 5A:
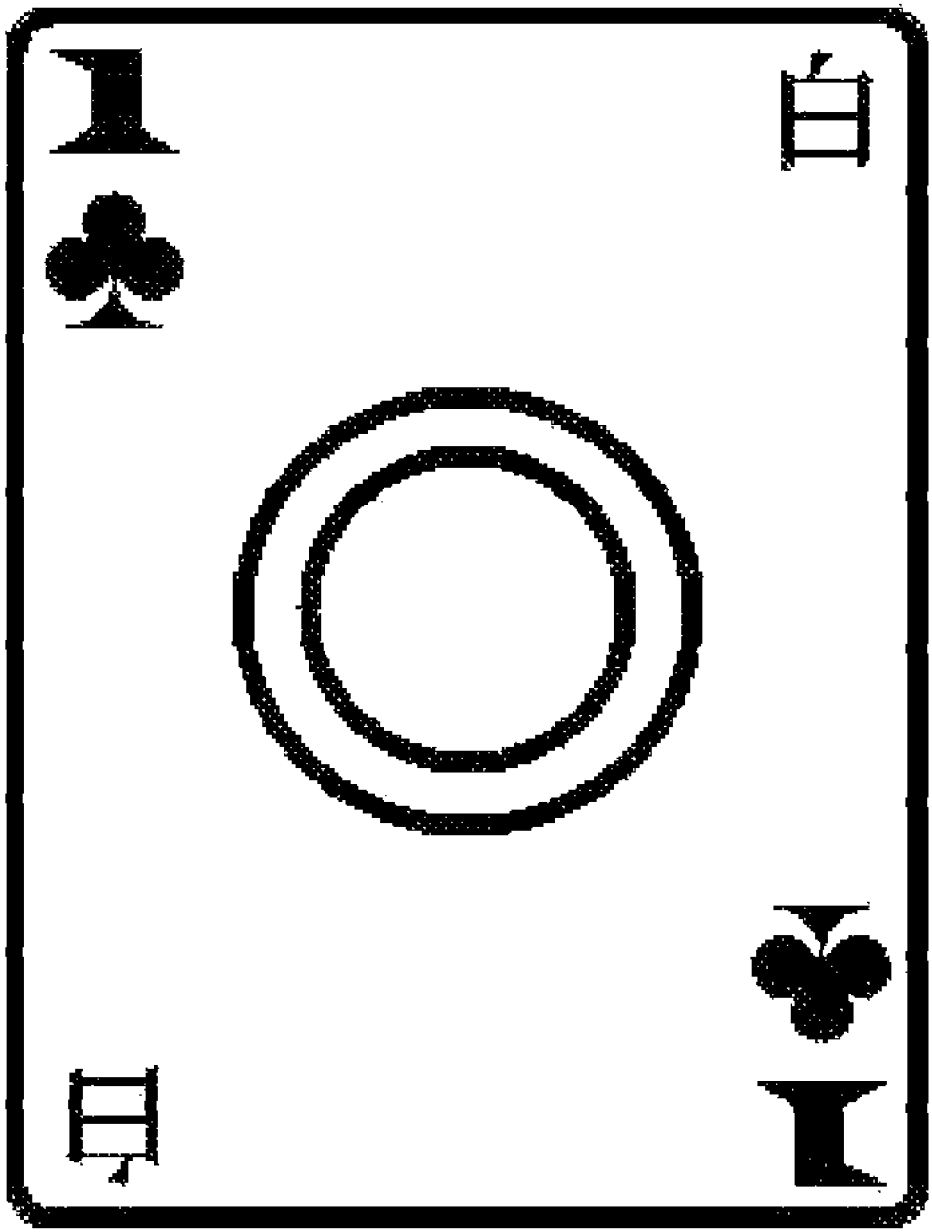
FIG. 5A is an illustration of a third group of 52 ring playing cards or tiles arranged in four rows, wherein the ring playing cards or tiles have displayed on one of their faces a "ring" symbol, a numerical rank ranging from 1 to 10, jack, queen, and king, and one of four suits selected from a spade, a heart, a club, or a diamond, all of which are associated with certain embodiments of the present invention.
Figure 8:
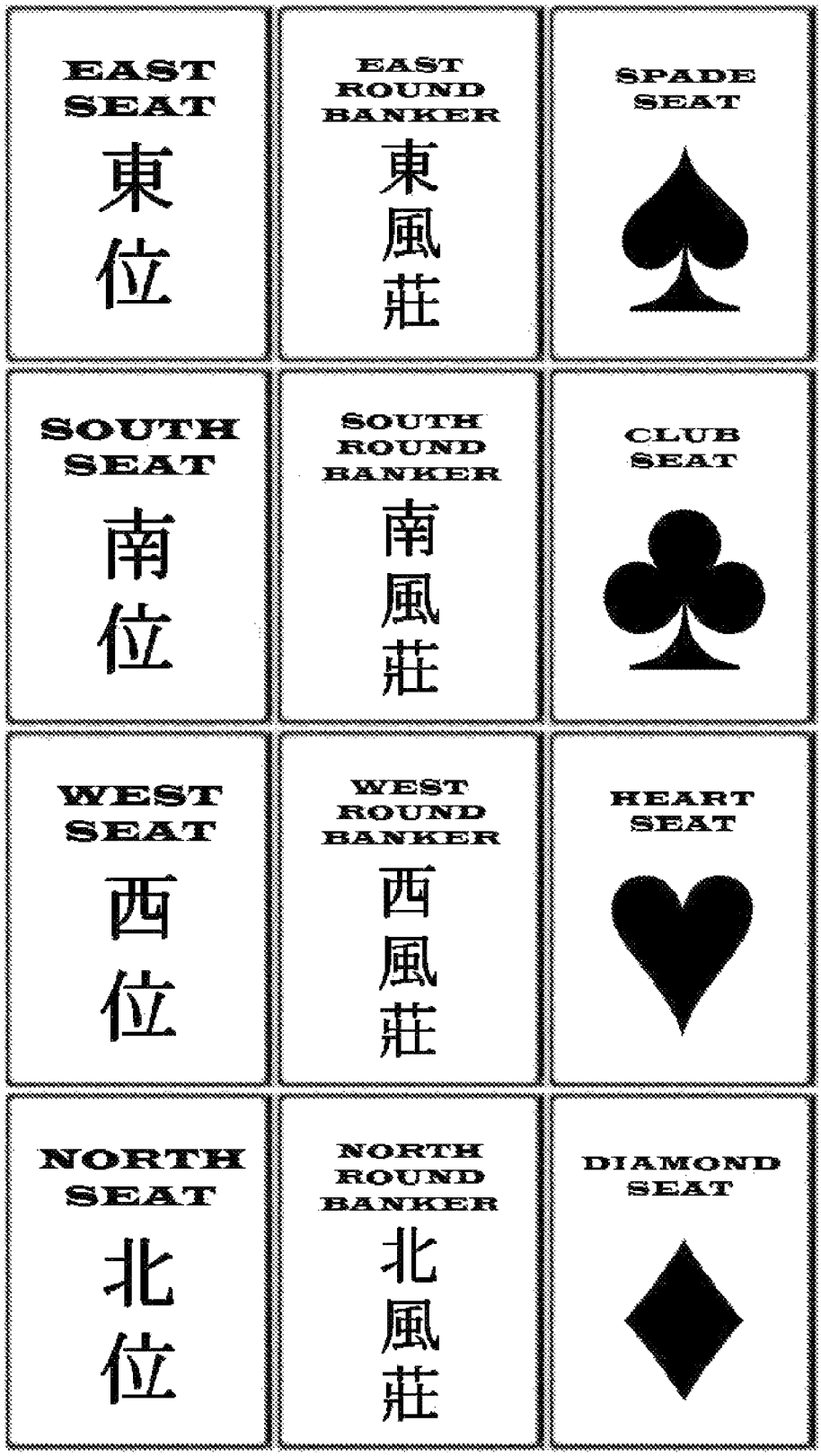
FIG. 8 is an illustration of a sixth group of 12 assistance cards or tiles arranged into three ordered columns with each column consisting of four different playing cards or tiles, all of which are associated with certain embodiments of the present invention.

More specifically, the set of 196 playing cards or tiles associated with one embodiment of the present invention may be divided into various groupings of like playing cards or tiles, namely: (1) a first group of 52 wan cards or tiles as illustrated in FIG. 3A; (2) a second group of 52 bamboo cards or tiles as illustrated in FIG. 4A; (3) a third group of 52 ring cards or tiles as illustrated in FIG. 5A; (4) a fourth group of 12 dragon cards or tiles as shown in FIG. 6; (5) a fifth group of 16 wind cards or tiles as illustrated in FIG. 7; and (6) a sixth group of 12 assistance cards or tiles as illustrated in FIG. 8. In sum, the set of 196 playing cards/tiles=52 wan cards/tiles+52 bamboo cards/tiles+52 ring cards/tiles+12 dragon cards/tiles+16 wind cards/tiles+12 assistance cards/tiles. Each of these various groupings of like playing cards or tiles are more fully described below.

Figure 3B:
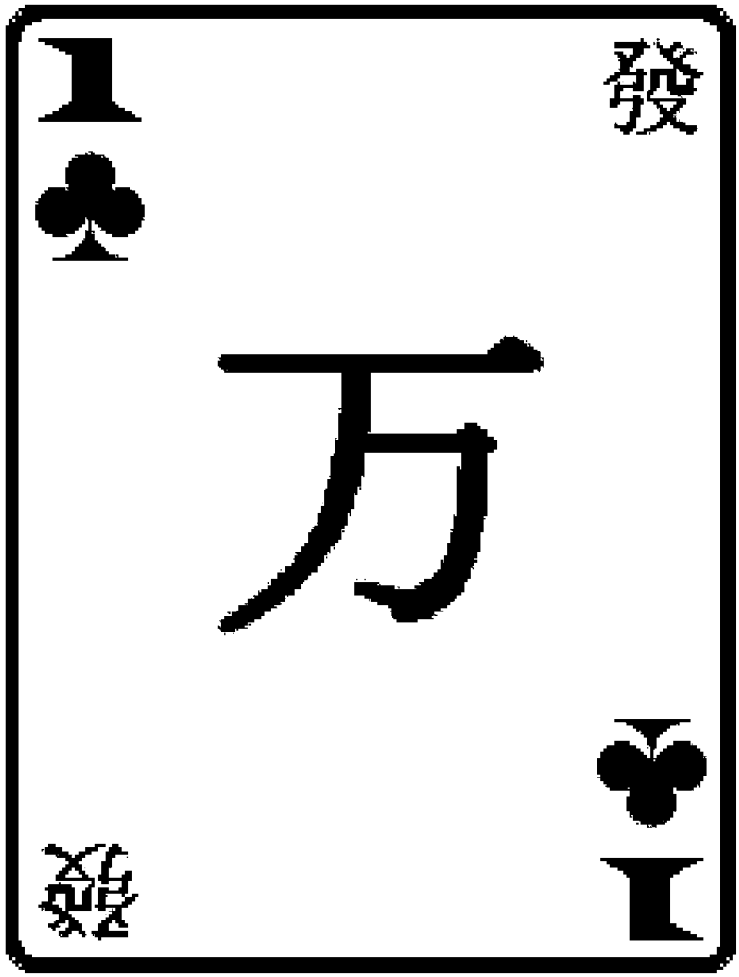
FIG. 3B is an illustration of a selected individual wan playing card or tile associated with certain embodiments of the present invention.

As best shown in FIG. 3A, each wan card or tile of the first group of 52 wan cards or tiles has displayed on one of its faces a "wan" symbol, a numerical rank selected the group consisting of a 1, 2, 3, 4, 5, 6, 7, 8, 9, 10, jack, queen, or king, and a suit selected from the group consisting of a spade, a heart, a club, and a diamond. As shown, the numerical rank and suit symbols are generally positioned on the upper left and lower right hand corners of each respective playing card or tile, whereas the wan symbol is more or less centrally positioned. Thus, the first group of 52 wan cards or tiles may be arranged into four ordered rows with each row consisting of 13 numerically ranked playing cards or tiles of the same suit. In addition, and as best shown in FIG. 3B, each wan card or tile also includes a first dragon symbol (selected from a group of first, second, and third dragon symbols) positioned on the upper right and lower left hand corners of each respective playing card or tile. In certain preferred embodiments, the color of the first dragon symbol and the numerical rank are the same (e.g., green).

Figure 4B:
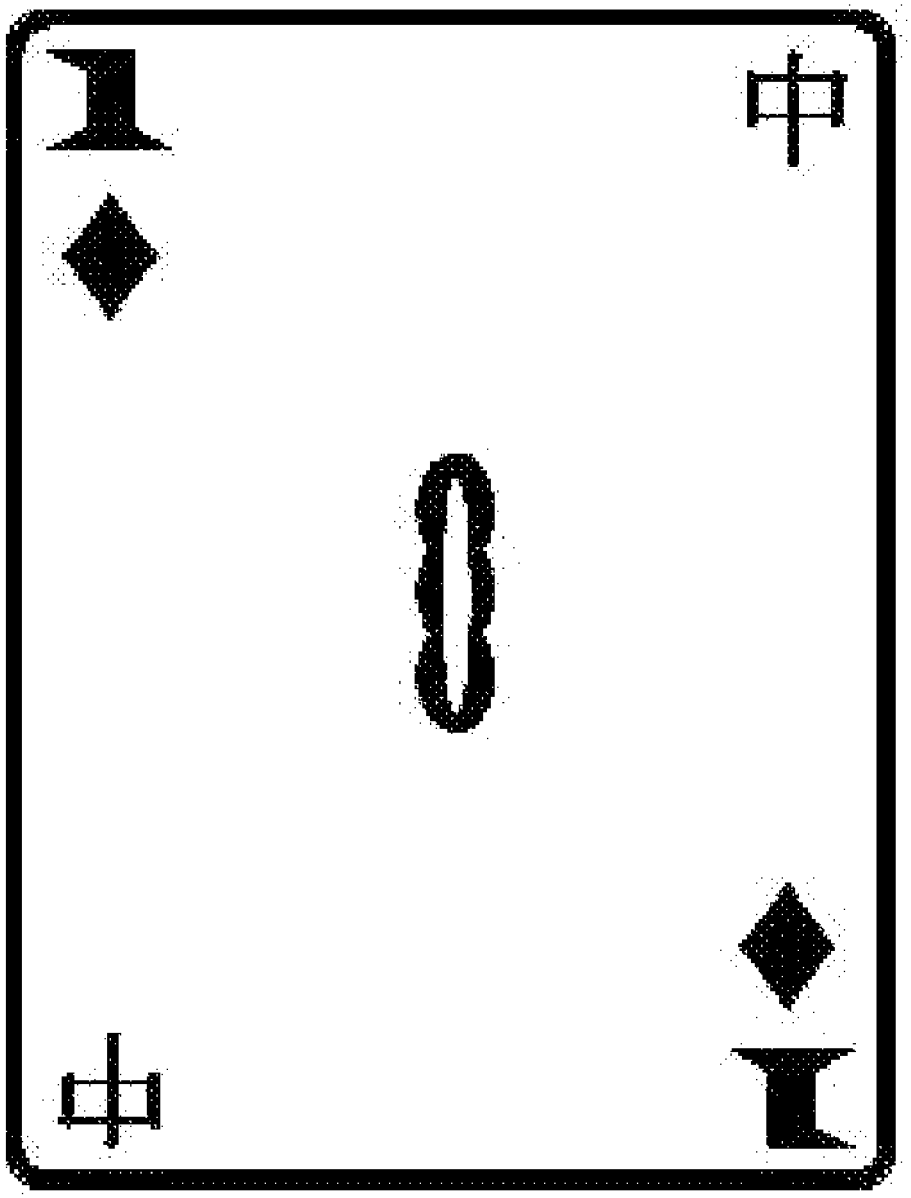
FIG. 4B is an illustration of a selected individual bamboo playing card or tile associated with certain embodiments of the present invention.

As best shown in FIG. 4A, each bamboo card or tile of the second group of 52 bamboo cards or tiles has displayed on one of its faces a "bamboo" symbol, a numerical rank selected the group consisting of a 1, 2, 3, 4, 5, 6, 7, 8, 9, 10, jack, queen, or king, and a suit selected from the group consisting of a spade, a heart, a club, and a diamond. As shown, the numerical rank and suit symbols are generally positioned on the upper left and lower right hand corners of each respective playing card or tile, whereas the bamboo symbol is more or less centrally positioned. Thus, the second group of 52 bamboo cards or tiles may be arranged into four ordered rows with each row consisting of 13 numerically ranked playing cards or tiles of the same suit. In addition, and as best shown in FIG. 4B, each bamboo card or tile also includes a second dragon symbol (selected from a group of first, second, and third dragon symbols) positioned on the upper right and lower left hand corners of each respective playing card or tile. In certain preferred embodiments, the color of the second dragon symbol and the numerical rank are the same (e.g., yellow).

Figure 5B:
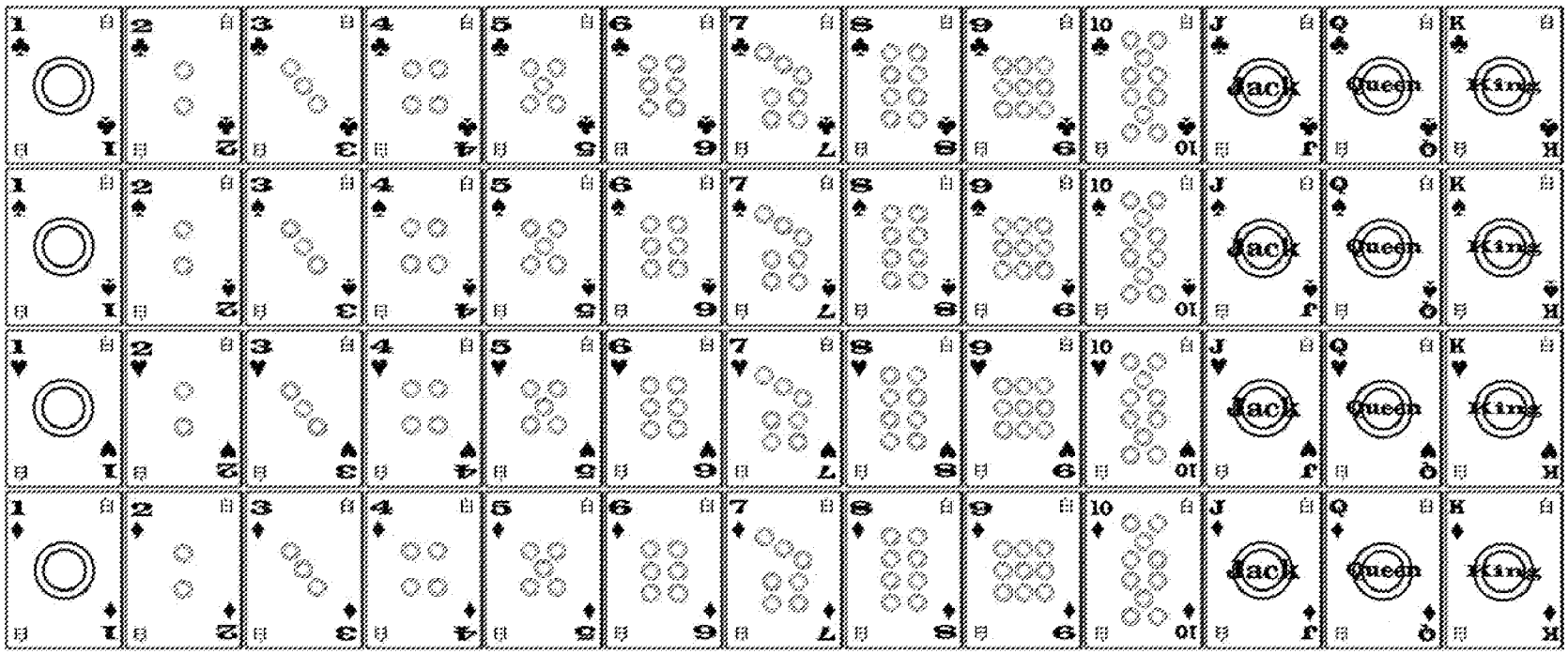
FIG. 5B is an illustration of a selected individual ring playing card or tile associated with certain embodiments of the present invention.

As best shown in FIG. 5A, each ring card or tile of the third group of 52 ring cards or tiles has displayed on one of its faces a "ring" symbol, a numerical rank selected the group consisting of a 1, 2, 3, 4, 5, 6, 7, 8, 9, 10, jack, queen, or king, and a suit selected from the group consisting of a spade, a heart, a club, and a diamond. As shown, the numerical rank and suit symbols are generally positioned on the upper left and lower right hand corners of each respective playing card or tile, whereas the ring symbol is more or less centrally positioned. Thus, the third group of 52 ring cards may be arranged into four ordered rows with each row consisting of 13 numerically ranked playing cards or tiles of the same suit. In addition, and as best shown in FIG. 5B, each ring card or tile also includes a third dragon symbol (selected from a group of first, second, and third dragon symbols) positioned on the upper right and lower left hand corners of each respective playing card or tile. In certain preferred embodiments, the color of the third dragon symbol and the numerical rank are the same (e.g., blue).

As best shown in FIG. 6, each dragon card or tile of the fourth group of 12 dragon cards or tiles has displayed on one of its faces a "dragon" symbol selected from a group of first, second and third dragons symbols (as shown in FIG. 1), a symbol of Chinese origin selected from the group consisting of a wan, a bamboo, and a ring, as well as a suit selected from the group consisting of a spade, a heart, a club, and a diamond. As shown, the suit symbols are generally positioned on the upper left and lower right hand corners, whereas the selected symbol of Chinese origin is generally positioned on the upper right and lower left hand corners, and whereas the selected dragon symbol is more or less centrally positioned on each respective playing card or tile. Thus, the fourth group of 12 dragon cards or tiles may be arranged into four ordered rows with each row consisting of three different dragon playing cards or tiles of the same suit. In certain preferred embodiments, the color of the selected dragon symbol matches the color of the selected symbol of Chinese origin (e.g., a green wan with a green dragon, a yellow bamboo with a yellow dragon, and a blue ring with a blue dragon).

As best shown in FIG. 7, each wind card or tile of the fifth group of 16 wind cards or tiles has displayed on one of its faces a "wind" symbol selected from a group of first, second, third, and fourth wind symbols (as shown in FIG. 1), as well as a suit selected from the group consisting of a spade, a heart, a club, and a diamond. As shown, the suit symbols are generally positioned on the upper left and lower right hand corners, whereas the selected wind symbol is more or less centrally positioned on each respective wind playing card or tile. Thus, the fifth group of 16 wind cards or tiles may be arranged into four ordered rows with each row consisting of four different wind playing cards or tiles of the same suit as shown.

As best shown in FIG. 8, each assistance card or tile of the sixth group of 12 assistance cards or tiles has displayed on one of its faces an indication of the players' seating arrangement for a particular round of play, an indication of which player is the "banker" (house) for a particular round of play, and a suit selected from the group consisting of a spade, a heart, a club, and a diamond. As shown, the indication markings and suit symbols are more or less centrally positioned on each respective assistance playing card or tile. Thus, the sixth group of 12 assistance cards or tiles may be arranged into three ordered columns with the first column consisting of four cards or tiles with different markings to indicate each of four different seats (East seat, South seat, West seat, and North seat), the second column consisting of four cards or tiles with markings to indicate each of four different bankers, and the third column consisting of four cards or tiles each with a different suit symbol selected from the group consisting of a spade, a heart, a club, and a diamond.

Figure 9:
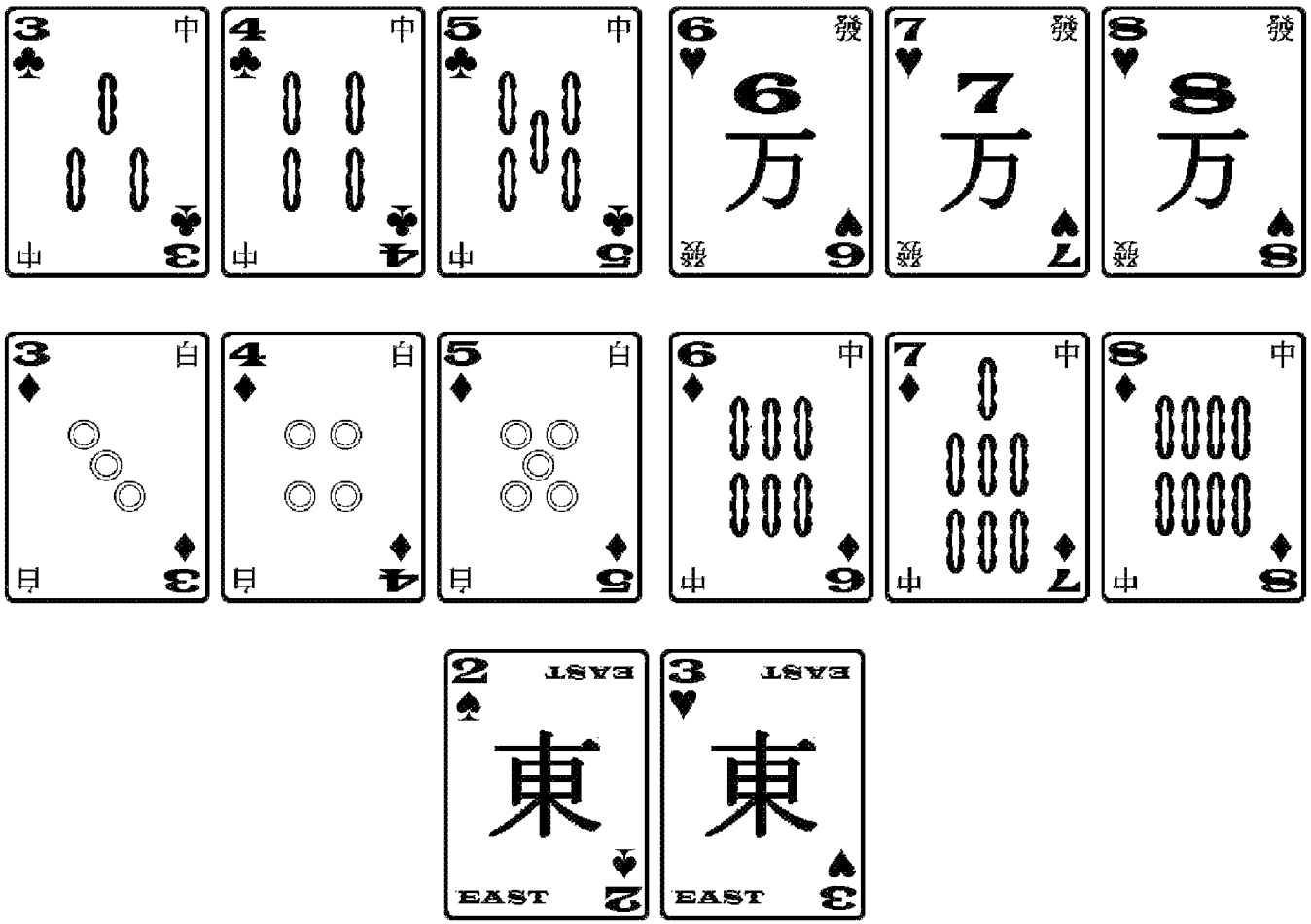
FIG. 9 illustrates an exemplary set of allowed combinations of cards/tiles and includes straight flush melds of bamboos, wans, and rings cards/tiles, as well as a pair of wind cards/tiles.

In other embodiments, the present invention is directed to playing one or more games using a plurality of the specialized playing cards or tiles as described above. In one particularly game variant (referred to as the game of "jokage") the objective or goal is to compile a complete set (hand) and to achieve the highest score. In this game variant each of four players is dealt 13 cards/tiles (with the banker receiving a $14^{th}$ card/tile to start the game) after seats are picked for each player. The goal during each round is for each player to draw and discard cards/tiles until an entire set of allowed combinations has been made. The first player who completes an entire set of cards/tiles of allowed combinations wins the round, and a total score for each round is calculated based on the combinations of cards/tiles. FIG. 9 illustrates an exemplary set of allowed combinations of cards/tiles and includes straight flush melds of bamboos, wans, and rings cards/tiles, as well as a pair of wind cards/tiles.

Figure 10:
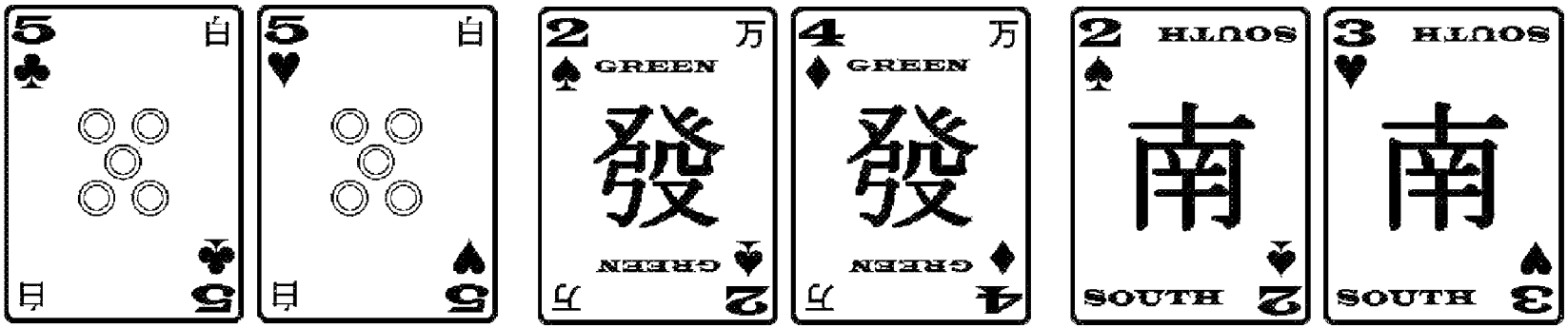
FIG. 10 illustrates three different exemplary pairs including a pair of like dragon cards/tiles, a pair of rings cards/tiles, and a pair of like wind cards/tiles.

A pair (also called "an eye") is defined as any two cards/tiles having the same symbol of Chinese origin, but of different suits. FIG. 10 illustrates three different exemplary pairs including a pair of like dragon cards/tiles, a pair of rings cards/tiles, and a pair of like wind cards/tiles.

Figure 11:
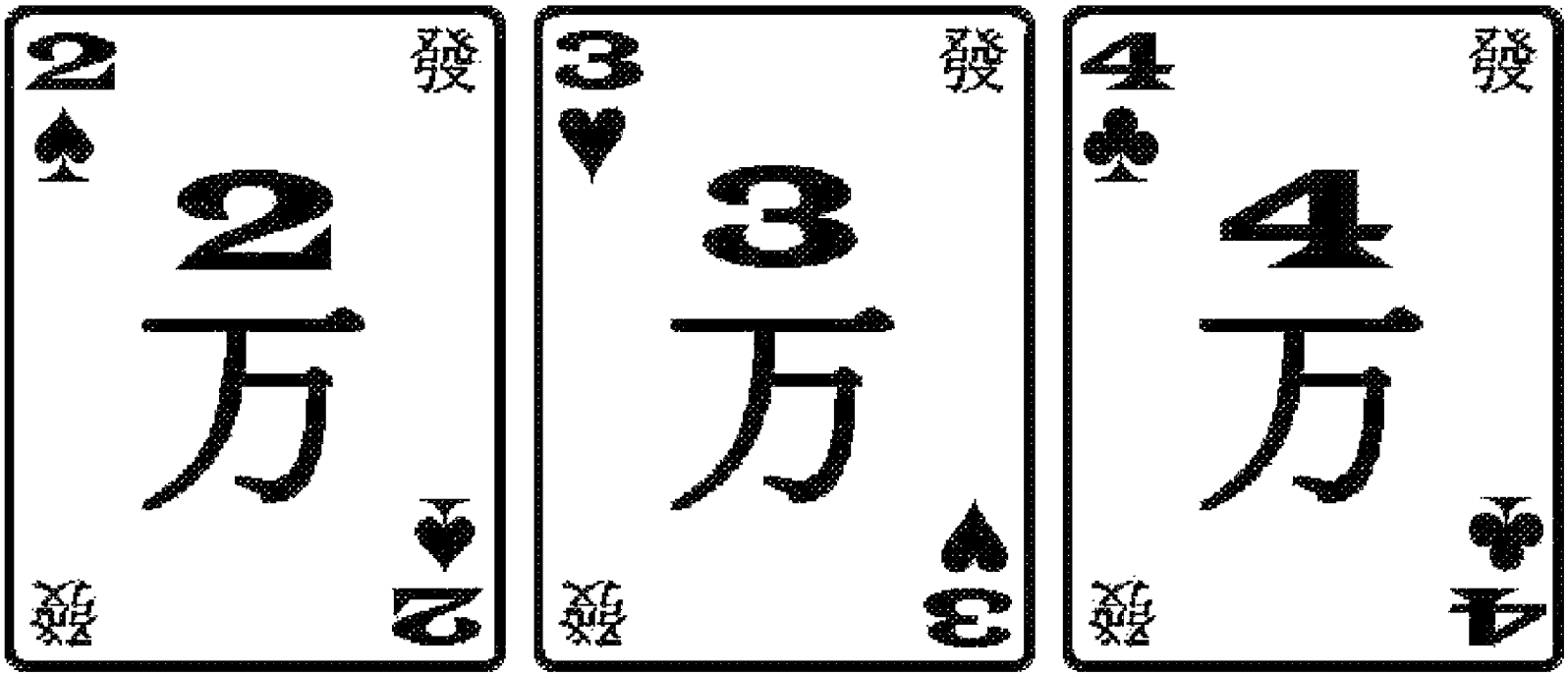
FIG. 11 illustrates an exemplary straight composed of the "2 wan of spades," the "3 wan of diamonds," and the "4 wan of clubs."

A meld is defined as any combination of three cards/tiles that forms a "straight," a "flush," "three of kind,' or a "straight-flush." In this regard, a straight is a set of any three cards/tiles having the same symbol of Chinese origin and that are numerically sequenced. FIG. 11 illustrates an exemplary straight composed of the "2 wan of spades," the "3 wan of diamonds," and the "4 wan of clubs." Dragon and/or wind cards/tiles cannot form part of a straight.

Figure 12:
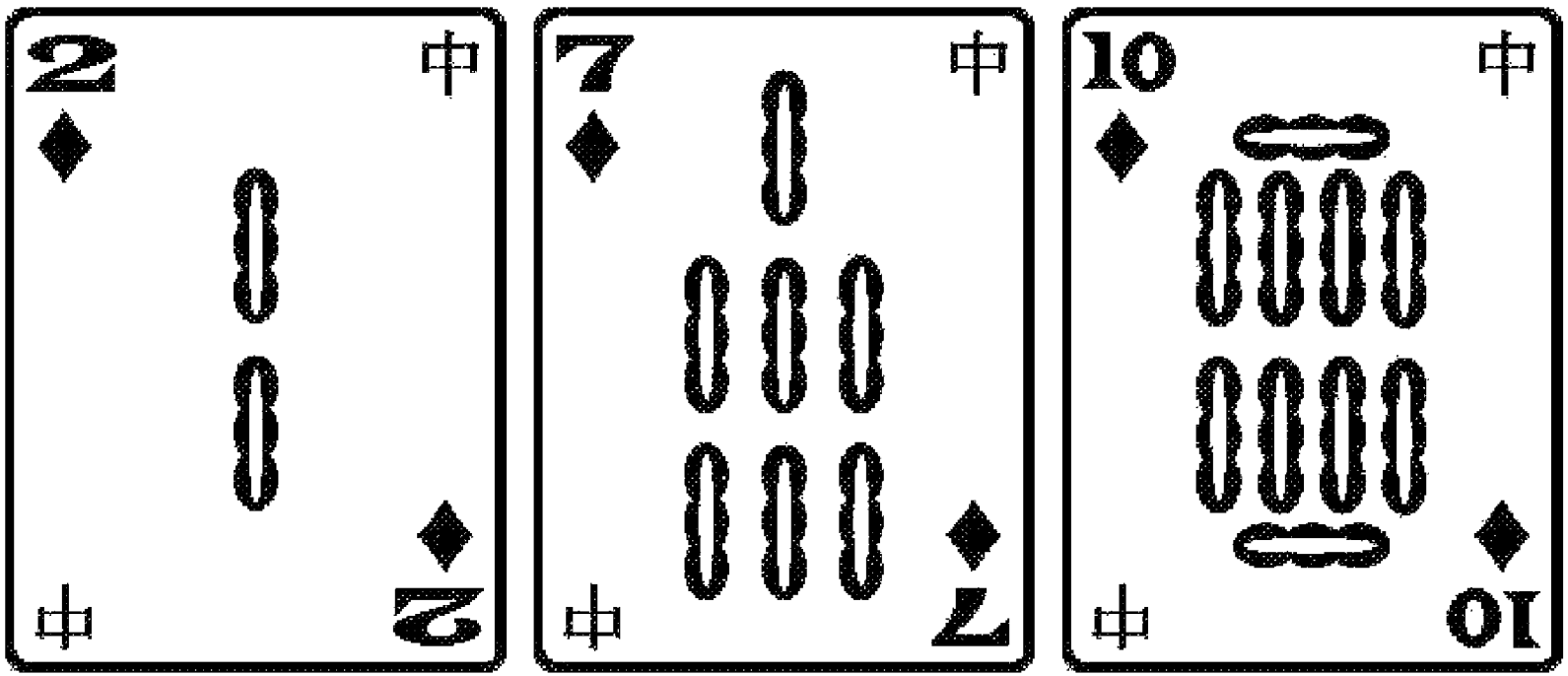
FIG. 12 illustrates an exemplary flush composed of the "2 bamboos of diamonds," the "7 bamboos of diamonds," and the "10 bamboos of diamonds."

A flush is not necessarily numerically sequenced, but consists of a set of any three cards/tiles having the same symbol of Chinese origin and suit. FIG. 12 illustrates an exemplary flush composed of the "2 bamboos of diamonds," the "7 bamboos of diamonds," and the "10 bamboos of diamonds." Dragon and/or wind cards/tiles cannot form part of a flush.

Figure 13:
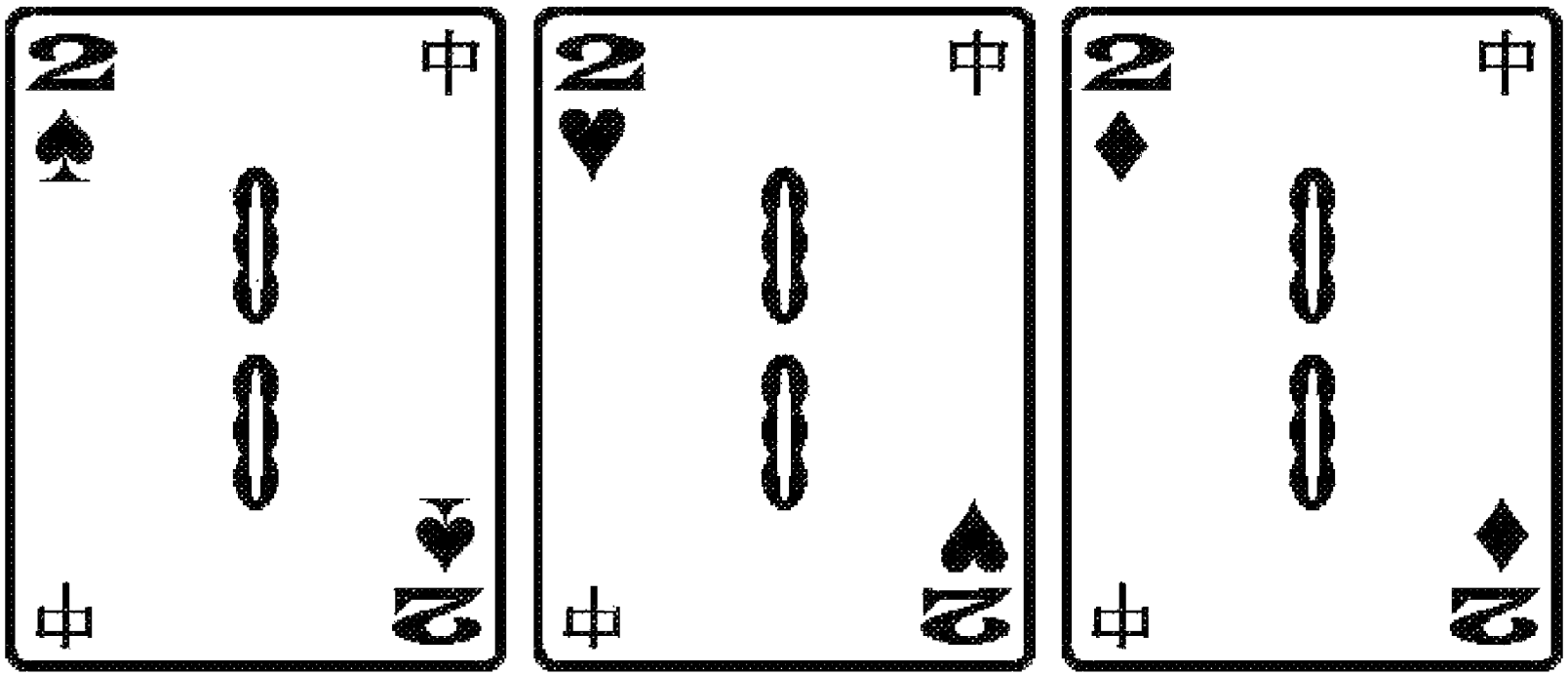
FIG. 13 illustrates an exemplary three of kind composed of the "2 bamboos of spades," the "2 bamboos of hearts," and the "2 bamboos of diamonds."

A three of a kind is a set of any three cards/tiles having the same numerical rank. FIG. 13 illustrates an exemplary three of kind composed of the "2 bamboos of spades," the "2 bamboos of hearts," and the "2 bamboos of diamonds." Unlike straights and flushes, dragon and/or wind cards/tiles can form part of a three of a kind.

Figure 14:
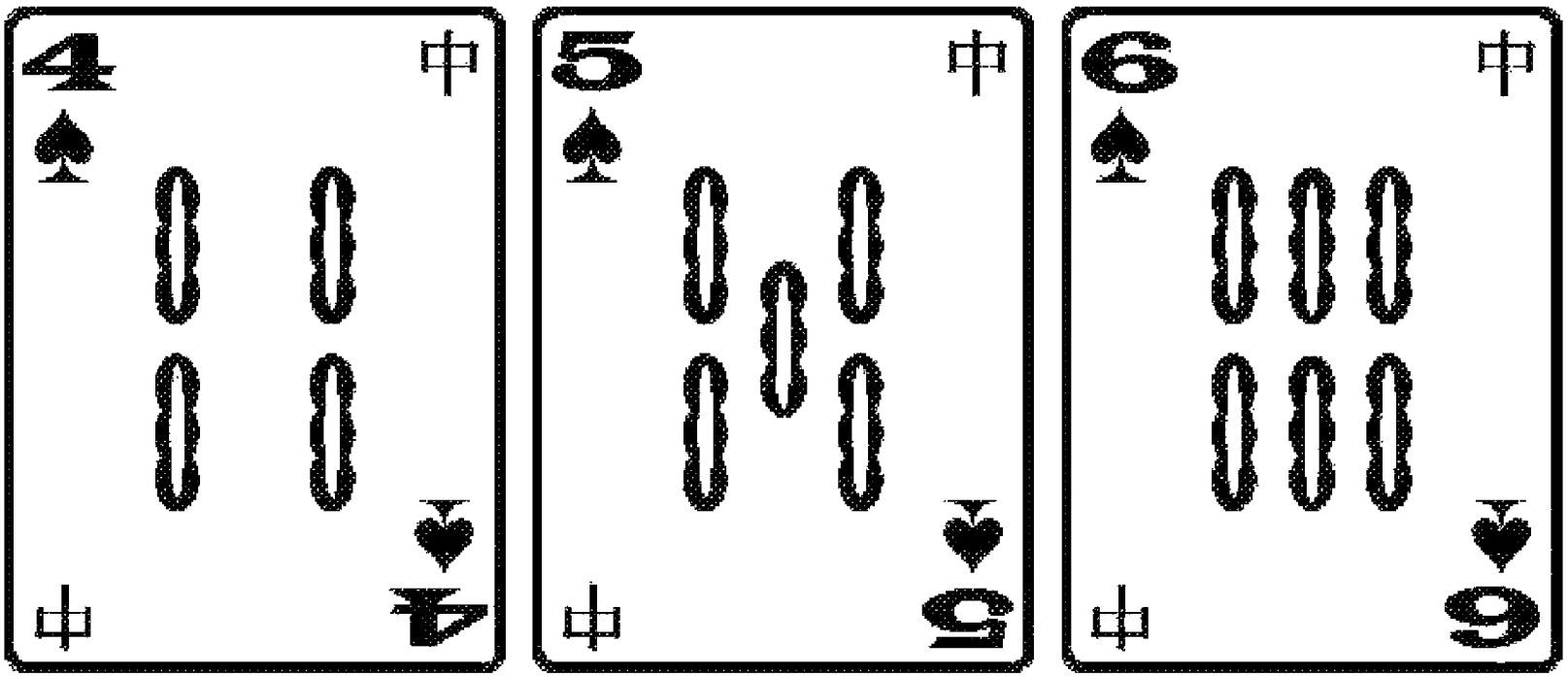
FIG. 14 illustrates an exemplary straight flush composed of the "4 bamboos of spades," the "5 bamboos of spades," and the "6 bamboos of spades."

A straight-flush is a set of any three cards/tiles having the same symbol of Chinese origin that are numerically sequenced and of the same suit. FIG. 14 illustrates an exemplary straight flush composed of the "4 bamboos of spades," the "5 bamboos of spades," and the "6 bamboos of spades." Dragon and/or wind cards/tiles cannot form part of a straight flush.

In view of the foregoing, the calculation of scores associated with hands of sets of cards/tiles of allowed combinations is a simple three-step process. First, each meld is awarded 1, 2, 3, or 4 points in accordance with the following table:

| | |
|---|---|
| Straight | 1 Point |
| Flush | 2 Points |
| Three of a Kind | 3 Points |
| Straight Flush | 4 Points |

Thus, if a set consist of all different symbols and suits, the total score is calculated as the sum of all of the meld scores. Second, any extra bonus points are calculated and added to the sum of the meld scores. If a winning hand consists of the same Chinese symbol and/or the same suits, extra bonus points are calculated. For extra bonuses, there is an additional scoring table based on symbols and suits:

| | |
|---|---|
| If all cards are the same Chinese symbol in different suits | The sum of all melds scores × 2 |
| If all cards are the same Chinese symbol in the same suits | The sum of all melds scores × 3 |
| If all cards are the same suits in different Chinese symbols | The sum of all melds scores × 2 |

Finally, each meld is matched with the assistance cards.

For example, if a winning hand has any meld with the wind direction card matching the wind seat card, add three extra bonus points to the winning hand. If a meld of a wind direction card matches the wind round card, add three extra bonus points to the winning hand. If a meld is a flush and matches the suit seat card, add two extra bonus to the winning hand. If a meld is a straight-flush and matches the suit seat card, add four extra bonus points to the winning hand.

Figure 15:
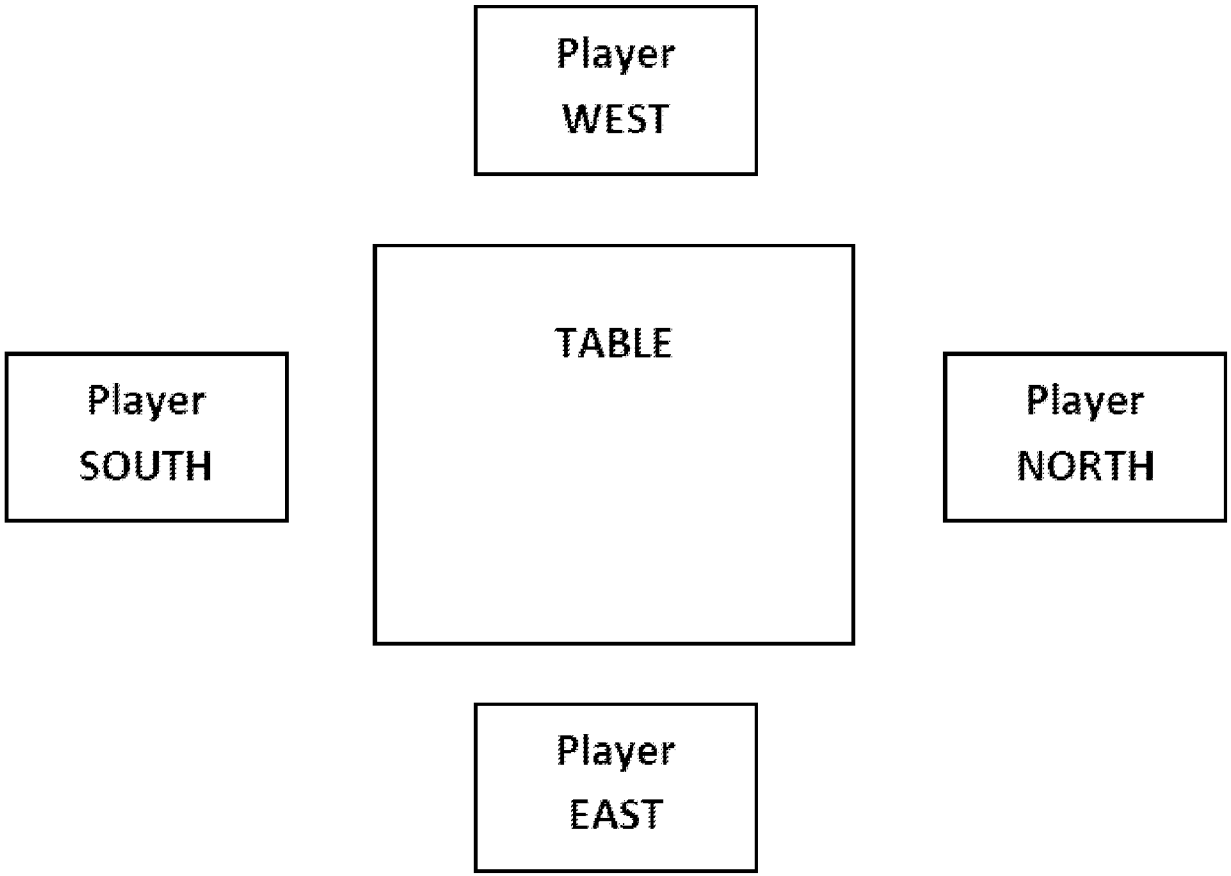
FIG. 15 illustrates a preferred seat arrangement in accordance with an embodiment of the present invention.
Figure 16:
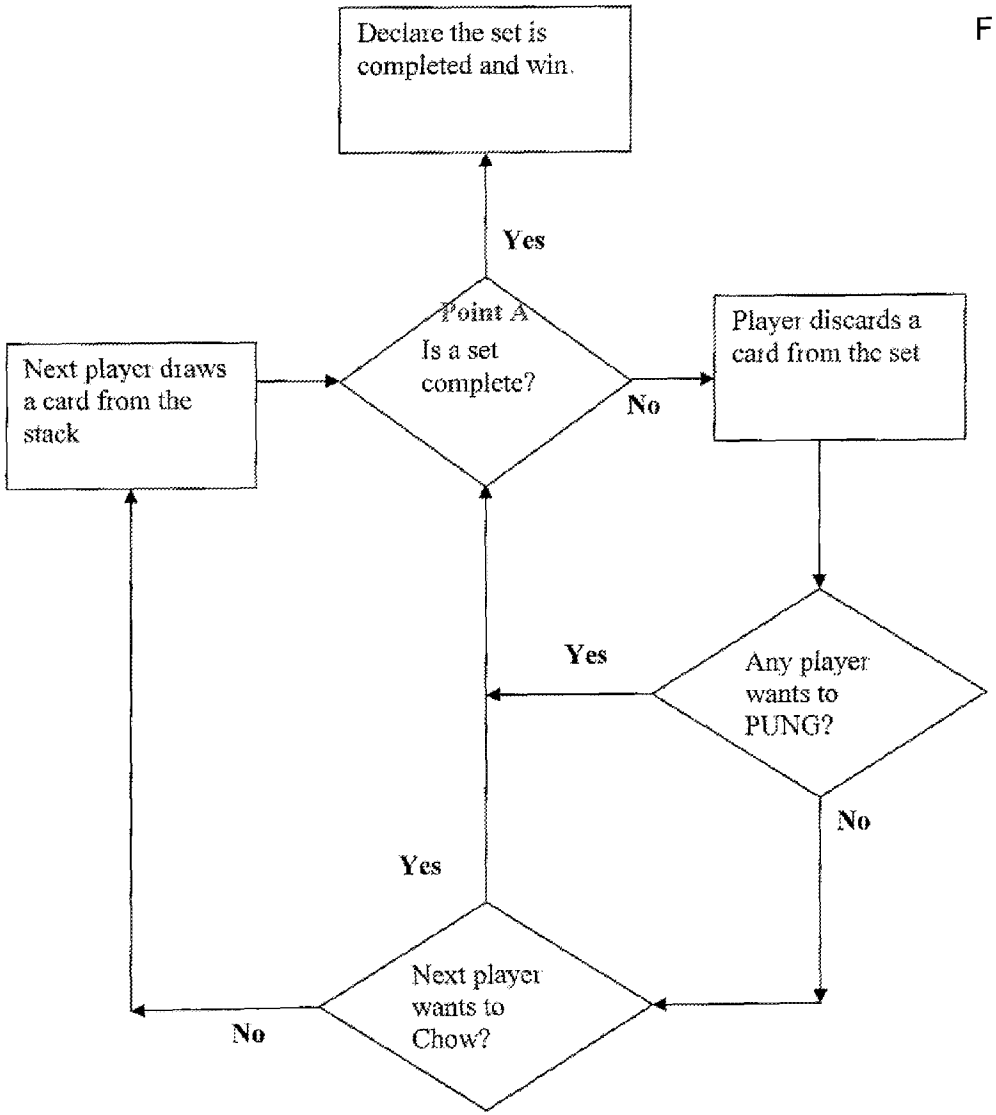
FIG. 16 illustrates a process flow diagram showing the flow of steps associated with playing a game using a set of specialized playing cards or tiles in accordance with an embodiment of the present invention.

Seat arrangement should follow clockwise around the table. The order goes EAST, SOUTH, WEST, and NORTH. FIG. 15 illustrates a preferred seat arrangement. The first game start with player EAST, then the next game starts by following the order East, South, West, and North. After the NORTH game is finished, the "EAST" WIND direction round is finished. The next round is "SOUTH" WIND, then followed by the "WEST" WIND round, and ending with the "NORTH" WIND round. Therefore, each complete set of rounds consists of four rounds: EAST WIND, SOUTH WIND, WEST WIND, AND NORTH WIND rounds. During a WIND round, the WIND direction banker card of that WIND direction is used by the banker. For example, during "EAST" WIND round, only the EAST ROUND BANKER card is used (not the other wind direction round banker card). Whoever is the banker will keep that card; such as at the beginning of the first game in "EAST" WIND round, EAST ROUND BANKER should be placed in front of player EAST. If player EAST loses after the first game is finished, he/she will pass the EAST ROUND BANKER card to the next player (player SOUTH).

To start the first game (of each WIND round) on EAST direction, each player is dealt with 13 cards/tiles in an order from EAST, SOUTH, WEST, and NORTH. Then the banker is dealt the $14^{th}$ card/tile and the round begins. Player EAST has to discard one of the cards/tiles in his/her set (hand), if the set is not completed. He/she must discard the card placed face up in the center. Other players can choose to pass or take the card/tile to complete a meld by PUNG. Only the next player (in this case, SOUTH player) can choose to PUNG or CHOW, if he/she wants and is able to complete a meld. If no players want to CHOW or PUNG then player SOUTH draws a card/tile from the stack and discards a card/tile. If no player claims that card/tile to CHOW or PUNG, the next player draws from the stack. These steps are repeated with players WEST and NORTH. The draw goes clockwise around the table back to player EAST and so on.

If a player discards a card/tile that is a card/tile for another player to complete a set then the player can claim that card/tile to complete a set and win. Example: if player EAST discards a card/tile and player NORTH can use that card to complete his/her set, then player NORTH can claim that card/tile and win.

If a card/tile is thrown and a player claims that, then the turn skips to the next player. Example, if player EAST draws and discards a card/tile and player WEST claims the tile (to PUNG), player WEST would have to discard a card/tile. Then if players EAST, SOUTH, AND NORTH do not claim the card/tile, the next player (in this case, NORTH) draws and discards a card/tile (basically, skipping player South because player West PUNG).

After a player discards a card/tile, the next player can claim that card/tile to form a Flush, Straight (CHOW), Three of a Kind (PUNG), or Straight Flush. The other two players can only claim that card/tile if they use the card/tile to form a Three of a Kind (PUNG). The player who claims the card/tile for a Three of a Kind (PUNG) has first priority over a Flush, Straight, and Straight Flush. Each time a player decides to claim a card/tile to form a Meld, he/she has to expose the Meld (put the set face up on the left side of his/her hand or corner of the table); these sets cannot be split or put back into players' hands after they are exposed.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

What is claimed is:

1. A game, comprising:

a plurality of playing cards or tiles, each card or tile having first and second faces, with each first face having displayed thereon a symbol of Chinese origin, a numerical rank symbol, and a suit symbol of French origin;

wherein the symbol of Chinese origin is selected from at least a first symbol, a second symbol, or a third symbol;

wherein the numerical rank symbol is selected from a 1, 2, 3, 4, 5, 6, 7, 8, 9, or 10; and wherein the suit symbol is selected from a spade, heart, club, or diamond;

the game being further characterized in that the plurality of playing cards or tiles define at least a first, second, and third distinct group of cards or tiles;

wherein the first group of cards or tiles includes a first plurality different cards or tiles all having the first symbol, and wherein the first plurality of cards or tiles may be arranged into four ordered first group rows, with each first group row consisting of an ordered sequence of numerically ranked playing cards or tiles of the same suit, and with each first group row having a selected suit that is different from each of the other first group rows;

wherein the second group of cards or tiles includes a second plurality of different cards or tiles all having the second symbol, and wherein the second plurality of cards or tiles may be arranged into four ordered second group rows, with each second group row consisting of an ordered sequence of numerically ranked playing cards of the same suit, and with each second group row having a selected suit that is different from each of the other second group rows; and wherein the third group of cards or tiles includes a third plurality of different cards or tiles all having the third symbol, and wherein the third plurality of cards or tiles may be arranged into four ordered third group rows, with each third group row consisting of an ordered sequence of numerically ranked playing cards of the same suit, and with each third group row having a selected suit that is different from each of the other third group rows.

2. The game according to claim 1, further comprising a fourth symbol of Chinese origin, wherein the fourth symbol is selected from a first dragon symbol, a second dragon symbol, or a third dragon symbol.

3. The game according to claim 2, further comprising a fifth symbol of Chinese origin, wherein the fifth symbol is selected from a first wind symbol, a second wind symbol, a third wind symbol, and a fourth wind symbol.

4. The game according to claim 3 wherein the numerical rank symbol further comprises a jack, a queen, and a king, and wherein the numerical rank symbol is selected from a 1, 2, 3, 4, 5, 6, 7, 8, 9, 10, jack, queen, or king.

5. The game according to claim 4 wherein the symbol of Chinese origin is centrally positioned on each of the plurality of playing cards or tiles.

6. The game according to claim 5 wherein the numerical rank symbol is positioned on a corner portion of each of the plurality of playing cards or tiles.

7. The game according to claim 6 wherein the suit symbol is positioned on a corner portion of each of the plurality of playing cards or tiles.

8. The game according to claim 7 wherein the suit symbol has a first or second selected color, and the first, second, and third dragon symbols has a third, fourth, or fifth selected color, and wherein the first, second, third, fourth, and fifth colors are different from one another.

9. The game according to claim 8 wherein the numerical rank symbol has the third, fourth, or fifth selected colors, and wherein the color of the selected dragon symbol is the same as the color of the selected numerical rank symbol.

10. The game according to claim 3, further comprising a fifth group of distinct playing cards or tiles, wherein the fifth group of cards or tiles includes fifth plurality of different cards or tiles all having the fifth symbol, and wherein the fifth plurality of cards or tiles may be arranged into four ordered fifth group rows, with each fifth group row consisting of four different playing cards or tiles of the same suit and including the first, second, third, and fourth wind symbols, and with each fifth group row having a selected suit that is different from each of the other fifth group rows.

11. The game according to claim 2, further comprising a fourth group of distinct playing cards or tiles, wherein the fourth group of cards or tiles includes a fourth plurality of different cards or tiles all having the fourth symbol, and wherein the fourth plurality of cards or tiles may be arranged into four ordered fourth group rows, with each fourth group row consisting of three different playing cards or tiles of the same suit and including the first, second, and third dragon symbols, and with each fourth group row having a selected suit that is different from each of the other fourth group rows.

12. The game according to claim 1 wherein the first symbol of Chinese origin is a wan symbol.

13. The game according to claim 1 wherein the second symbol of Chinese origin is a bamboo symbol.

14. The game according to claim 1 wherein the third symbol of Chinese origin is a ring symbol.

* * * * *